US008956177B2

(12) United States Patent
Warner

(10) Patent No.: US 8,956,177 B2
(45) Date of Patent: Feb. 17, 2015

(54) ELECTRICAL CORD/OUTLET SAFETY LOCK AND METHOD

(71) Applicant: Shawn L. Warner, Duncansville, PA (US)

(72) Inventor: Shawn L. Warner, Duncansville, PA (US)

( * ) Notice: Subject to any disclaimer, the term of this patent is extended or adjusted under 35 U.S.C. 154(b) by 0 days.

(21) Appl. No.: 13/716,858

(22) Filed: Dec. 17, 2012

(65) Prior Publication Data

US 2013/0183855 A1 Jul. 18, 2013

Related U.S. Application Data

(60) Provisional application No. 61/576,862, filed on Dec. 16, 2011.

(51) Int. Cl.
*H01R 13/639* (2006.01)

(52) U.S. Cl.
CPC ..... *H01R 13/6395* (2013.01)
USPC ..... 439/373

(58) Field of Classification Search
USPC ..... 439/373, 369, 371, 443
See application file for complete search history.

(56) References Cited

U.S. PATENT DOCUMENTS

| | | | | | |
|---|---|---|---|---|---|
| 4,652,069 | A * | 3/1987 | Smith | 439/369 |
| 5,348,495 | A * | 9/1994 | Kasden | 439/371 |
| 5,655,924 | A * | 8/1997 | Cross et al. | 439/373 |
| 6,095,846 | A * | 8/2000 | Becerra | 439/371 |
| 6,769,930 | B1 * | 8/2004 | McDevitt, Jr. | 439/373 |
| 7,014,493 | B1 * | 3/2006 | Battard | 439/373 |
| 7,722,380 | B1 * | 5/2010 | West et al. | 439/373 |
| 7,857,654 | B2 * | 12/2010 | West et al. | 439/373 |

* cited by examiner

*Primary Examiner* — Alexander Gilman
(74) *Attorney, Agent, or Firm* — Gary P. Topolosky

(57) ABSTRACT

There is disclosed a device for securing an electrical cord and plug to a power outlet covered by a standard plate cover. The device comprises a first (male) unit having an axial arm that terminates in a base with a plurality of flat hooks for fitting at least partially behind a lateral edge of the standard plate cover. There is also a second (female) unit with its own axial arm terminating in a base with flat hooks for fitting behind the standard plate cover, preferably opposite the first (male) unit. The device further comprises means for connecting the first and second units together to form a bridge about the electrical cord being secured. That bridge slidably adjusts along the axial arms of the two units towards the plug end in its power outlet. A method of use is also disclosed.

19 Claims, 15 Drawing Sheets

ELECTRICAL CORD/OUTLET SAFETY LOCK AND METHOD

REFERENCE TO RELATED APPLICATION

This application is a perfection of U.S. Provisional Ser. No. 61/576,862, filed on Dec. 16, 2011, the disclosure of which is fully incorporated by reference herein.

BACKGROUND OF THE INVENTION

1. Field of the Invention

The present invention relates to the field of electrical power cords and outlets. It further relates to locks for holding plugs and/or power cords to their electrical outlets as means for making wall outlet receptacles safer and more shock resistant, especially for young children. Particularly, it relates to a safety lock for any standard, i.e. non-customized, outlet cover plate for engaging the cord to its wall outlet thereby making it difficult to accidentally remove. A related method is also disclosed and claimed.

A special problem exists for the power plugs of a desktop computer. Should that plug become dislodged, even partially, for any reason while the computer is in use, inputted data which has not been backed up will be lost and require reentry.

Yet another problem is the inconvenient removal of the plug to a household appliance such as a vacuum. This occurs all too frequently when cleaning about a room full of furniture. It is annoying to have to periodically replug in one's vacuum after its power cord has been pulled free from the wall socket.

For hospital machinery/equipment and for many industrial-type workshops, it is quite important that the power cords to many devices remain anchored to their respective wall sockets/outlets and eliminate the chance of any accidental unplugging.

2. Description of Relevant Art

Numerous methods/devices are known for trying to render safe a power outlet cord by making it more difficult to separate from the wall outlet and cause a shock hazard. Some show electrical plug "locks"; others describe specific directional means for covering a plug in its outlet. Representative references will now be briefly discussed in chronological order.

Smith U.S. Pat. No. 4,652,069 shows a plug retaining device with its own intermediate base plate semi-permanently secured to the wall outlet faceplate. A generally U-shaped retaining member slidably engages with plate arms having channels for receiving spaced apart pins.

Santilli U.S. Pat. No. 4,702,709 is a simplified device which employs a bracket pivotally mounted to the wall cover plate. That bracket includes a retaining bar with a pair of parallel legs extending from both ends of that retaining bar, said legs being designed to engage a recess formed in a peripheral edge of the specially modified faceplate.

Peckham U.S. Pat. No. 4,851,612 describes an outlet protector having a transparent housing with tabs for mating with notches on at least one edge of its customized baseplate. By pinching these tabs inwardly, cords plugged into one or both power sockets are housed in this protector before passing/extending through one or more slots in the sidewall to its housing element.

Kasden U.S. Pat. No. 5,348,495 shows a special electrical socket faceplate with laterally spaced locking brackets extending outwardly from both sides of each outlet. Those bracket pairs engage with a base clamp member through which a power cord plug is detachably secured, that base clamp member having pivoting locking "arms".

In Buckner et al. U.S. Pat. No. 5,575,677, a power cord plug is retained in a cubical or rectangular box with a slot terminating at an open side of the box. This box includes a pair of flanges held in place with double-side adhesive foam tape.

Cross et al U.S. Pat. No. 5,655,924 shows an electrical plug retainer system with a customized plate cover having opposed "lugs" on opposite sides, said lugs designed to receive the flanges to a clip retainer that holds the plug cord.

Blackman U.S. Pat. No. 6,071,142 claims to prevent power cord removal from a wall outlet with a wire surround that includes a bridge with a clamp about the cord proper. A pair of perpendicular members extend down from opposite sides of that bridge, each perpendicular member terminating in a suction cup for attaching to the wall, outside the expected spread area of a standard wall outlet cover plate.

Becerra U.S. Pat. No. 6,095,846 shows a retainer for securing an electrical plug to its socket by essentially banding the plug through the holes of a ladder-like wrap strapped about the plug and plate cover before reconnecting to itself.

In Johnston U.S. Pat. No. 6,491,539, a plug assembly retainer is shown that holds the power/plug wire closest to the plug head with a band or other retention member. That band secures to a support arm which, as shown, has a screw head for holding the wall plate to the threaded aperture between sockets of a typical outlet pair.

McDevitt, Jr. U.S. Pat. No. 6,769,930 claims a childproof outlet adapter with a specialty cover arrangement in which toothed apertures flank each electrical receptacle opening, said apertures designed to releasably engage with a pair of spaced flexible leg segments extending downwardly from a base member that surrounds the electrical cord adjacent the plug head.

Battard U.S. Pat. No. 7,014,493 shows a retaining socket for electrical outlets in which a slotted plug clip holds the cord and plug head before pairs of clip ends engage with pairs of spaced clip receivers on either side of the outlet covered by a specially customized wall plate.

Campbell III et al. U.S. Pat. No. 7,056,145 shows a plug securing device that covers the entire outlet with a slotted box through which a power cord is fed before connecting to its own specially designed wallplate/cover.

Finally, West et al U.S. Pat. No. 7,722,380 discloses a plug retention clip with a pair of arms that slidably connect to a body slotted to hold a plug wire. These arms then slidably engage with slots on either side of a specially designed outlet cover/casing.

While the aforementioned constructions may be adequate for the basic purpose and function for which they have been designed, they are deficient in failing to provide an uncomplicated, efficient and yet practical outlet lock that requires no specially modified outlet plate covers in order to securely hold a plug/power wire adjacent the outlet/socket for minimizing the likelihood of any accidental pull out from the same.

SUMMARY OF THE INVENTION

It is an object of the invention to provide a novel plug lock assembly (and method) that can be used to childproof electrical plugs which plug into a standard house wire socket/outlet.

It is another object to provide a novel cord lock assembly that is economical to both manufacture and market.

It is another object to provide a novel cord and outlet lock device that is relatively easy to install without requiring any tools (special or otherwise).

It is a further object to provide a plug power lock (and method) that is not too difficult for an adult to remove and separate apart when no longer needed, said power lock being available for reuse at the same location or elsewhere at a later time.

It is yet another object of this invention to provide a plug removal locking means which effectively prevents a power plug from being accidentally (or unintentionally) pulled from its wall outlet. This invention attaches directly about the power cord and secures its plug end to the outlet and outlet cover immediately adjacent the wall thereby preventing any tensions on the cord from being communicated/transferred to the plug.

It is another object of the invention to produce a power plug lock which can withstand a casual or even stronger tug/pull on the cord and remain plugged into its wall outlet.

It is a further object of the invention to provide plug securing means which readily attach onto/about the cord wire (regardless of its relative thickness) nearest its plug end.

The electrical cord plug lock assembly of this invention has been designed to prevent a child from fully or partially removing a plug from its wall outlet/socket possibly resulting in a potentially fatal electrical shock to the child. This device holds each plug to a standard outlet plate cover so tightly that a child cannot put his/her finger or an object between the socket and a loosened plug.

This device allows an adult to install, remove and reinsert about a power cord and plug without any tools so that repeated use is not inconvenient.

A second use of this power lock assembly is for computer safety, i.e. preventing accidental plug removal while the computer is in use.

A third use prevents the inconvenient accidental removal of plugs to household appliances like a vacuum while in use.

A fourth application locks hospital equipment/machines to their wall power sources.

Yet another end use addresses the need to lock certain industrial type machines in place so that they can't become accidentally unplugged.

A typical household wall outlet has two sockets, most often arranged vertically, one atop the other. Occasionally, these outlets extend horizontally or emanate from a floor, or possibly even a ceiling arrangement. In most every instance, a dual socket/outlet configuration has an outlet cover plate (or face plate) through which the outlets are accessed for power plug in.

Each plug lock assembly for the present invention is intended to lock one electrical plug to one electrical outlet/socket. This will allow the other socket of two accessible for occasional, temporary or other convenient use. In some cases, the parents of small children insert a plastic safety device into such "uncommitted" power outlets. Such devices are readily available in the market place. Of course, if desired, both top and bottom outlets of a wall socket can be locked to respective power plugs by using a tandem of two plug lock assemblies according to the present invention.

This invention secures power cords to its wall outlet so that the cord cannot be easily pulled out, thereby childproofing the cord to the wall. It attaches the cord to a standard, unmodified outlet plate cover by essentially hooking, clipping, or "lipping" onto lateral edges of that plate cover in a substantially vertical plane, before being adjusted in a direction perpendicular to that plane and towards the wall outlet itself.

There is disclosed a device for securing an electrical cord and plug to a power outlet covered by a standard plate cover. The device comprises a first (male) unit having an axial arm that terminates in a base with a plurality of flat hooks for fitting at least partially behind a lateral edge of the standard plate cover. There is also a second (female) unit with its own axial arm terminating in a base with flat hooks for fitting behind the standard plate cover, preferably opposite the first (male) unit. The device further comprises means for connecting the first and second units together to form a bridge about the electrical cord being secured. That bridge slidably adjusts along the axial arms of the two units towards the plug end in its power outlet. A method of use is also disclosed.

Restated, one preferred embodiment of this device here includes: two half units, a "male" half and a "female" half intended to join together and connect about a power plug wire by forming an adjustable bridge between the two halves. Each half unit consists of a main sliding arm that terminates in one or more footed hooks, prongs or tines, these items being designed to latch onto and at least partially behind a wall outlet face plate for securing the left and right side sliding arms to the outlet being secured.

Preferably, one side of each sliding arm is toothed for engaging with the male or female wire surrounding bridge component to the respective half units. These respective bridge components move axially up and down the toothed sides to their respective sliding arms, preferably in a synchronized manner AFTER the two bridge components have been joined together to surround a power cord/wire situated in a common bridge aperture made when the two halves are brought together. The male bridge half has a forklike appearance with at least two protrusions designed to fit and lock into matching apertures in the female bridge half. As shown, the forward most tips to the male protrusions will extend outwardly past their female aperture counterparts so as to serve as means for squeezing together and unlocking the two joined halves when disconnecting the device from its power cord and plug. For easier axial movement of the bridge halves along their respective sliding arms, their exteriors include a curved thumb rest.

Ideally, the aforementioned embodiment is made, in sections, from moldable plastic resin. It can hold (and secure) power cord wires that are quite thick in diameter, relatively thin and even partially flattened in overall appearance. Should overly thin wiring (such as phone connector wires) be considered for locking to an outlet, the central bridge aperture formed by joining the two bridge halves together may be fitted with one or more space adapters for better securing the bridge about much thinner wiring.

Preferred applications will prevent power cords for appliances (including lamps, vacuums, kitchenware, hardware devices, etc., from being accidentally or intentionally yanked from their outlets/sockets. As such, this invention provides satisfactory levels of childproofing to standard power outlets. A secondary benefit would be to safeguard computer power cords from being pulled out prematurely and/or major medical/hospital equipment from being accidentally unplugged.

BRIEF DESCRIPTION OF THE DRAWINGS

Further features, objects and advantages of the present invention will be made clearer in the following detailed description of preferred embodiments made with reference to the accompanying drawings in which.

DESCRIPTION OF PREFERRED EMBODIMENTS

This invention prevents an electrical plug from being removed from its standard wall outlet. More particularly, the invention relates to a device for attaching about the power cord or wire before advancing same toward the plug in end adjacent the wall outlet/socket. It secures to a standard wall faceplate cover for preventing the plug from being inadvertently pulled out/away from its outlet/socket.

A standard plug for AC outlets in the U.S. employs two or three plate-like prongs that extend into slots in the typical power outlet/socket. These slots usually contain spring clips for providing some resistance to insertion and withdrawal of the plug prongs. The spring clips help hold the prongs "in" the outlet. They also prevent the weight of the cord alone from pulling the plug wire from the outlet proper. However, such clips do not provide sufficient resistance for holding the prongs in when placed under significant tension.

Vacuums are usually one of the worst culprits. Users test the range of a power cord to see just how far the vacuum will reach before having to unplug and relocate to another outlet. Power tool operators are another frequent offender. When working on a project, the drill or saw user often tries to see just how far his/her tool will reach without stopping for a necessary extension cord. Generally, whenever a cord is plugged in another room and out of view, the user will continue to pull until his/her plug is yanked from its outlet.

When a standard power cord is placed under tension, it will tend to pull free from its wall outlet/socket. Sometimes, when that plug breaks free, it is not always a "clean break". If the tension/pulling force comes from an angle other than perpendicular to the outlet, the plug prongs may bend as they exit their outlet slots. In addition, frequent pulls on the cord may weaken and eventually break connections with the plug end.

In the accompanying FIGS., common elements are commonly numbered (and lettered) in the respective views.

Figure 1:
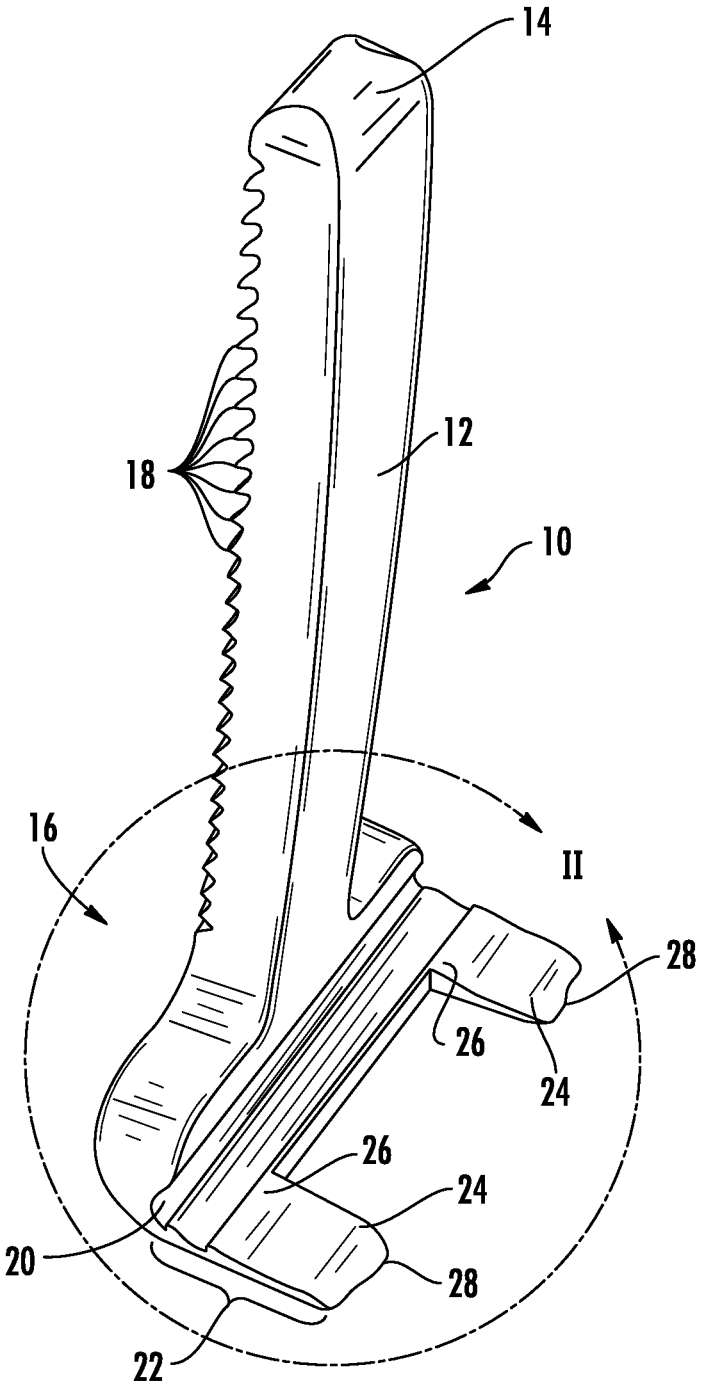
FIG. 1 is a perspective view of an axial arm component according to one embodiment of this invention.
Figure 2:
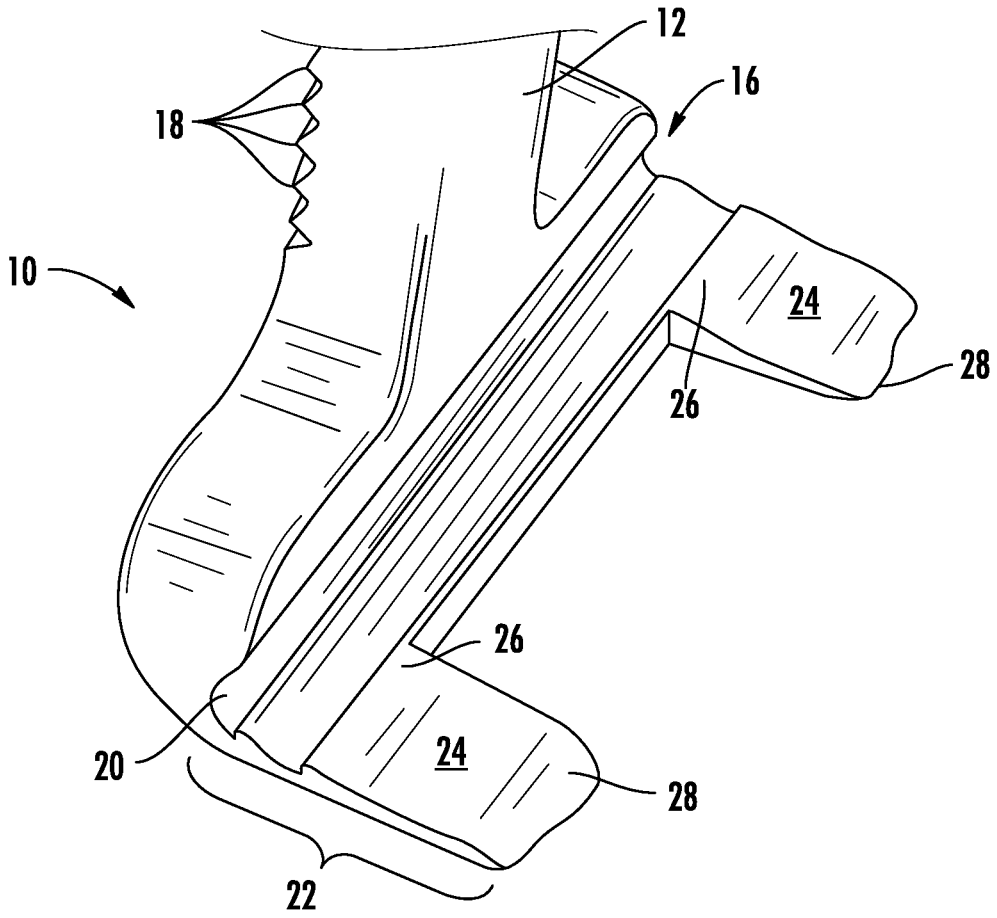
FIG. 2 is a perspective view of the flat hooked end to that axial arm, a close up of the circled region II in FIG. 1.
Figure 3:
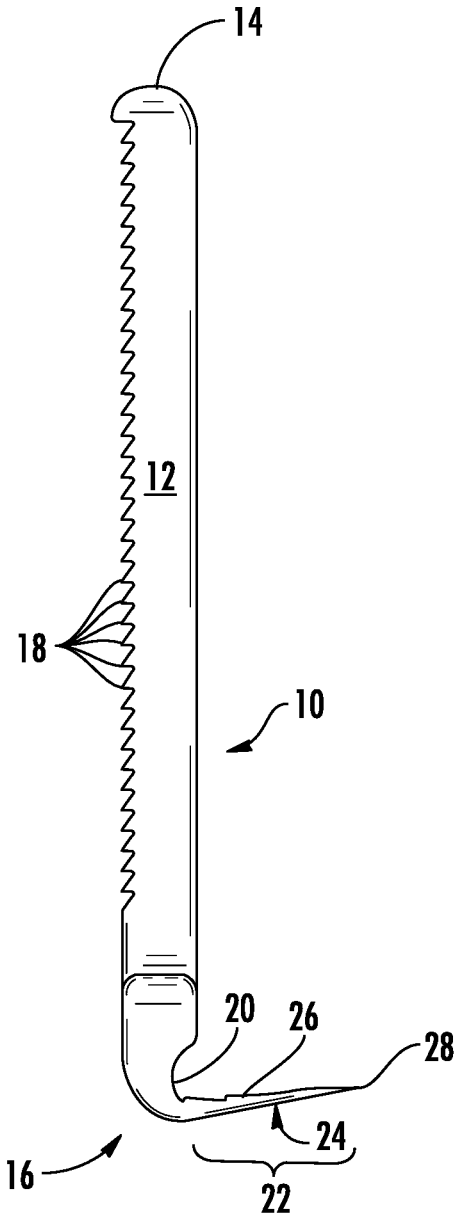
FIG. 3 is a left side plan view of the axial arm from FIG. 1.

Referring now to FIGS. 1-3, there is shown in several views one preferred embodiment of axial arm 10 according to this invention. Arm 10 includes an elongated stem portion 12 that is polygonal in cross section, preferably rectangular-shaped. Stem portion has a top 14 and base 16. As shown, an outside face to stem portion 12 is made with a plurality of teeth 18 for interacting/engaging with a tooth lock component in the male and female bridge elements over and through which the stem portion extends.

One preferred embodiment of base 16 to stem portion 12 has a lipped indent 20 angled to then extend in a planar component 22 substantially perpendicular to stem portion 12. Planar component consists of a plurality of ledges, catches or flat, footed hooks 24. They may also be referred to as prongs or tines. Preferably, they bevel somewhat from their rear end 26 to their front tips 28 so that each hook 24 can be wedged behind an existing standard outlet faceplate cover as shown and described later herein. Though, the accompanying drawings show a planar component with flat hooks 24 at opposite ends, it is to be understood that alternate versions may include one continuous (longer/wider) hook, hooks that extend outwardly but from other than the two "side ends" to planar component 22, or consist of multiple (more than two) hooks/prongs for holding to the perimeter of a standard outlet faceplate cover.

FIGS. 4-7 show the male half unit 30 of this invention. That unit comprises a main body element 32 having an aperture 34 towards one end, said aperture designed to receive the stem 12 to one axial arm 10. A ledge (element L in FIG. 7) internal to aperture 34 engages with the teeth 18 of said stem for relative adjustment of the fully assembled unit closer to the power cord plug end and wall outlet/socket as described later hereinbelow.

External to aperture 34 is a curved protrusion 36. It serves as a thumb rest for pushing the fully assembled unit closer toward the plug end and wall.

Figure 4:
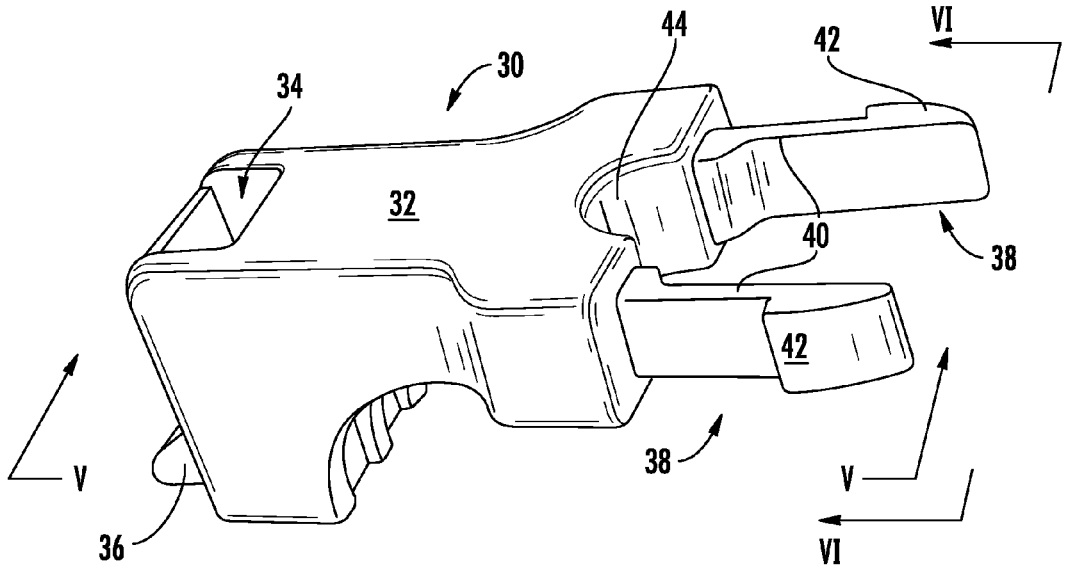
FIG. 4 is a top perspective view of the male connector unit for one embodiment of this invention.
Figure 5:
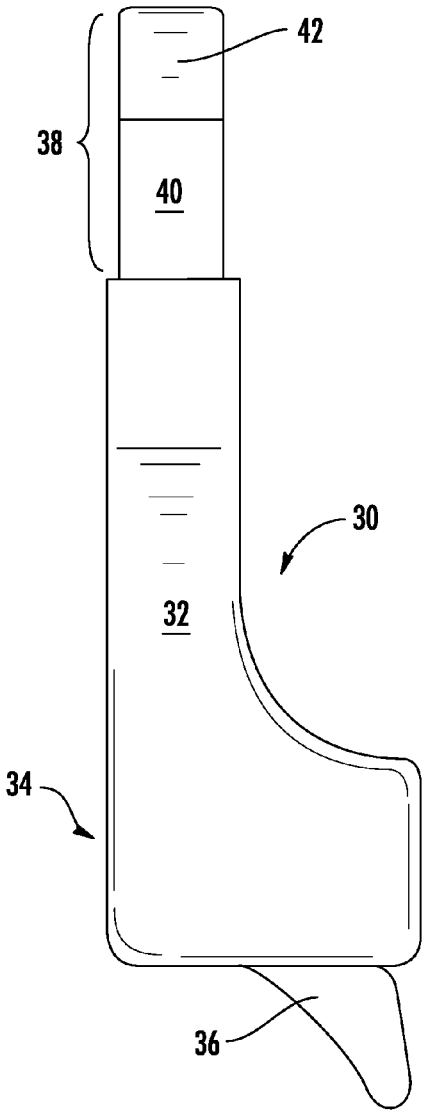
FIG. 5 is a right side plan view of that male connector unit taken along lines V-V of FIG. 4.
Figure 6:
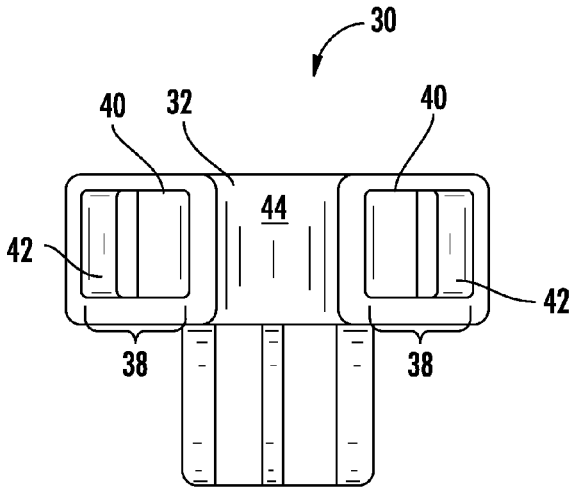
FIG. 6 is a front plan view of that male connector unit taken along lines VI-VI of FIG. 4.
Figure 7:
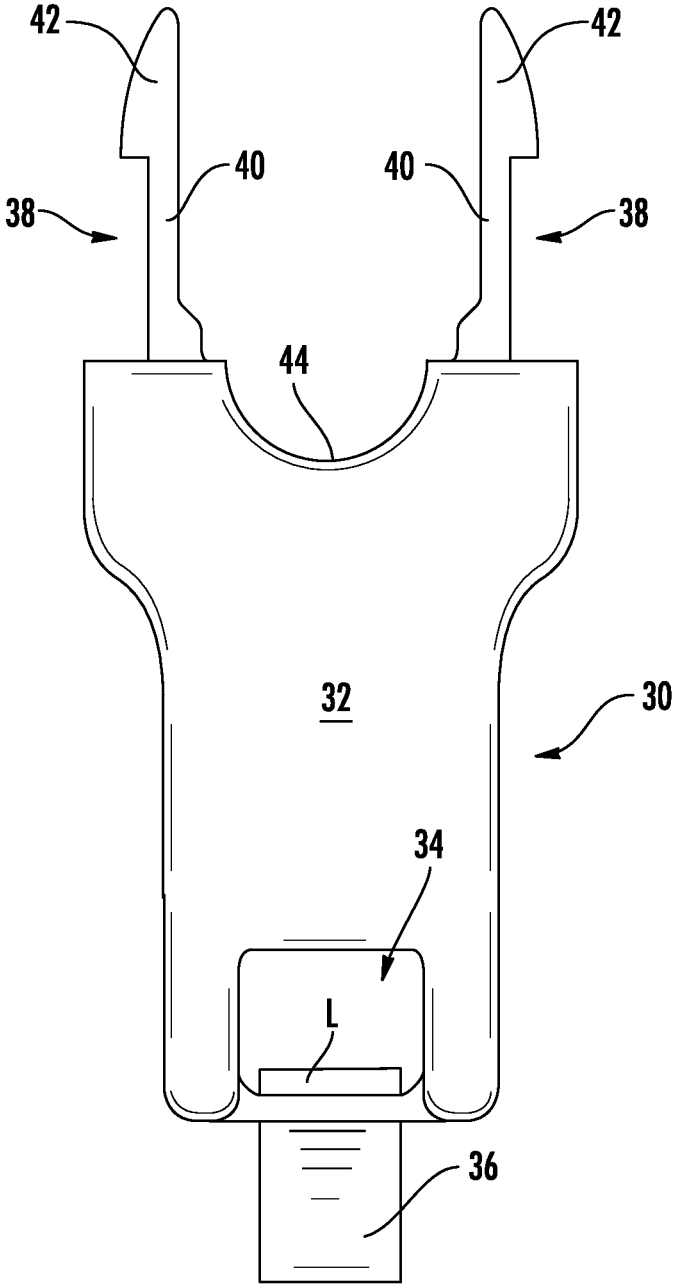
FIG. 7 is a top plan view of the male connector unit from FIG. 4.
Figure 8:
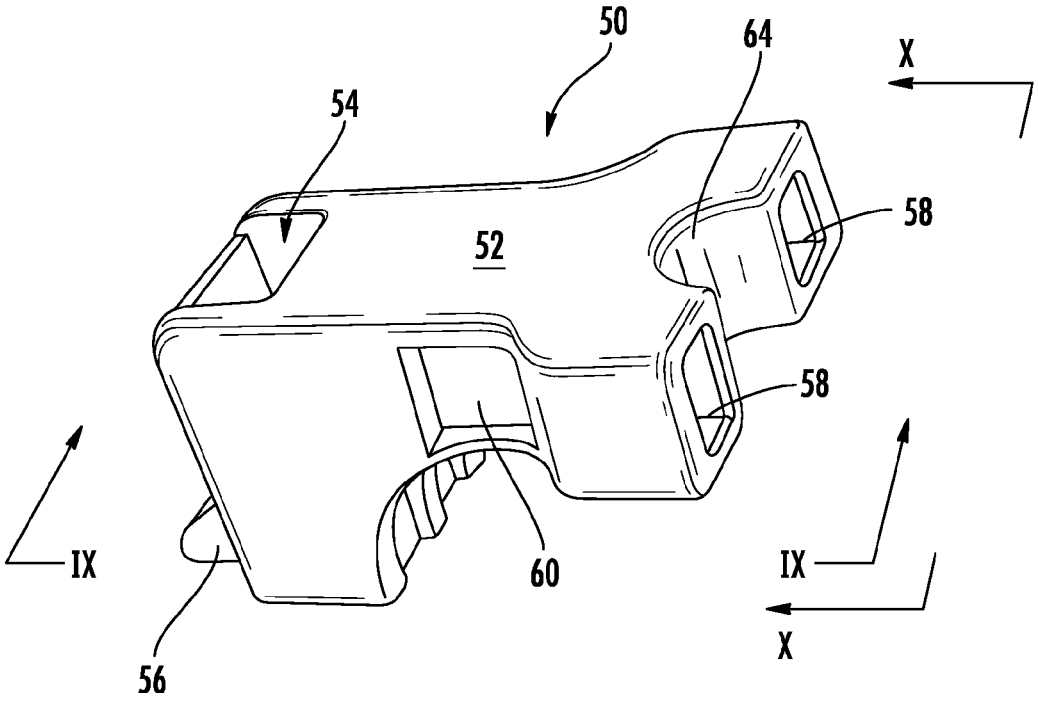
FIG. 8 is a top perspective view of the female connector unit for one embodiment of this invention.
Figure 9:
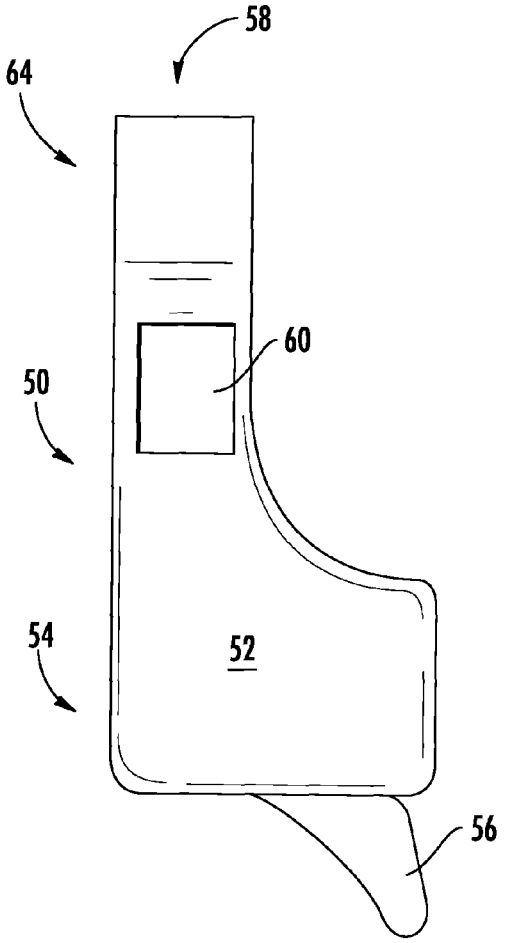
FIG. 9 is a right side plan view of that female connector unit taken along lines IX-IX of FIG. 8.
Figure 10:
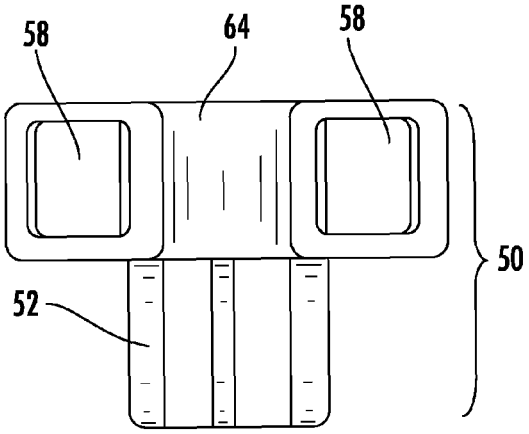
FIG. 10 is a front plan view of that female connector unit taken along lines X-X of FIG. 8.
Figure 11:
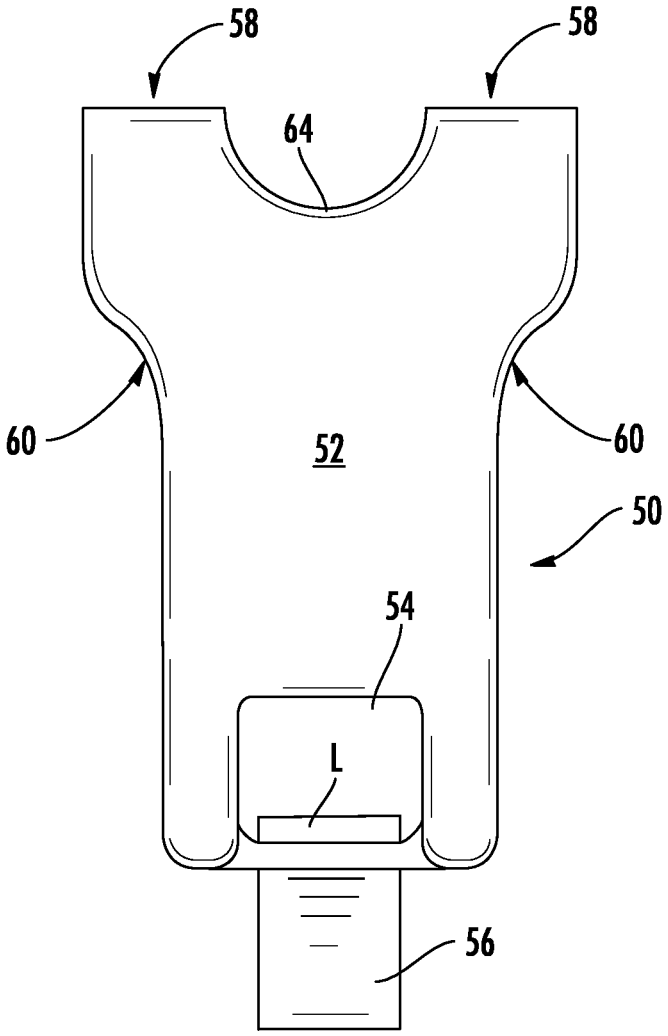
FIG. 11 is a top plan view of the female connector unit from FIG. 8.

Opposite curved protrusion 36, male half unit 30 includes a pair of opposed tongue-like protrusions 38 extending substantially horizontally, or along the major body portion of male half unit 30 in FIG. 4. These protrusions each have an arm component 40 and wedgelike tip end 42, the latter mating with a corresponding aperture in the female half unit described below. The two arm components 40 sandwich an arcuate region 44 of the male half unit. This region, when coupled with its female half unit counterpart, forms an aperture through which the wire of a power cord extends when the device is fully installed. Alternate viewing angles for male half unit 30 are seen from the perspective of lines V-V (as right side view FIG. 5), lines VI-VI in FIG. 4 (as front view FIG. 6) and a top plan view per accompanying FIG. 7.

FIGS. 8-11 focus on the female equivalent half unit 50 with its main body element 52, axial arm aperture 54 and push-down curved thumb protrusion 56. As best seen in front view FIG. 10 (as taken from the angle of line X-X in FIG. 8), female half unit 50 includes a pair of opposed apertures 58 which each extend as channels in main body element 52 before terminating as exit holes 60 for the wedge-like tip ends 42 of the male half unit 30. When disconnecting a device from about the power cord and plug that it secured, these tip ends 42 can be pinched or otherwise hand squeezed together (towards one another) before pulling the male unit out and away from the opposed apertures 58 in female half unit 50.

And like its male unit counterpart, a section of main body element 52 for female half unit 50, preferably between opposed apertures 58, includes its own arcuate region 64 that combines with its male unit equivalent 44 to form the power wire aperture-surround. Note, this surround is sized to fit most any power cord wire shape, thickness and/or diameter. It can also accommodate the flatter wiring of some extension cords. Should the wire be overly thinning, such as for a phone line extension plug-in, one or more collars/wire surrounds (not shown) may be added for inserting about the wire during device installation.

Figure 12:
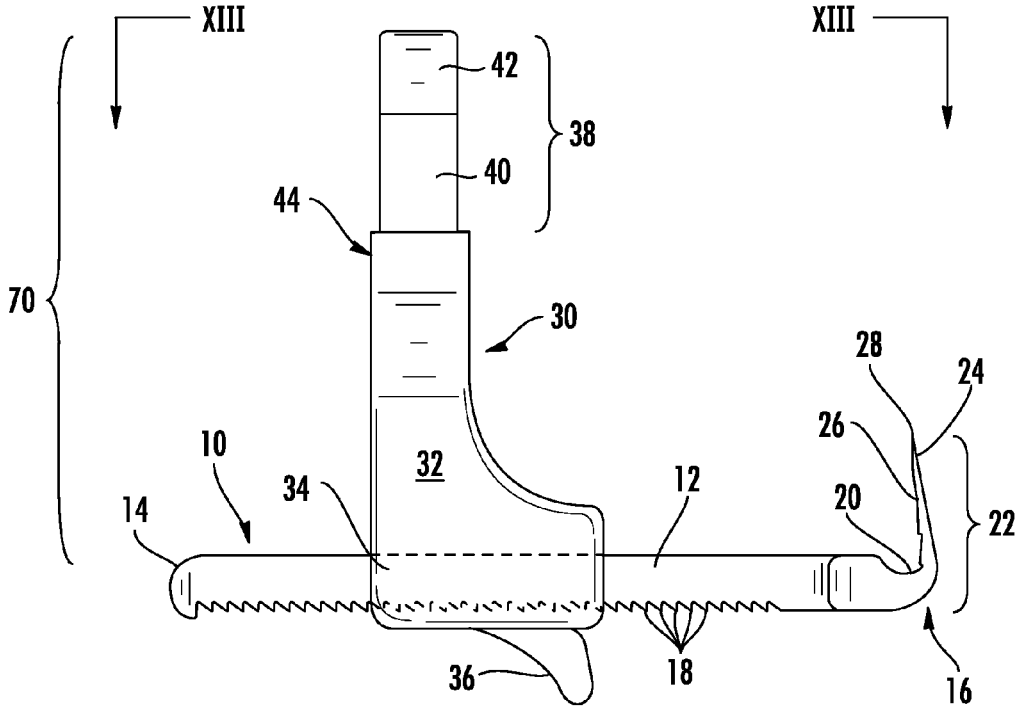
FIG. 12 is a side plan view of the male connector unit on its axial arm according to one embodiment of this invention.
Figure 13:
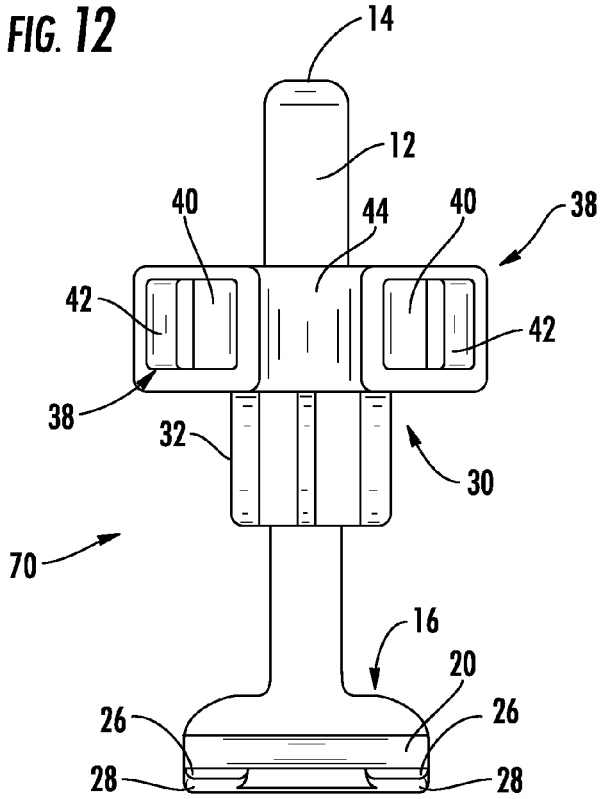
FIG. 13 is a front plan view of the combined elements from FIG. 12 taken along lines XIII-XIII of FIG. 12.
Figure 14:
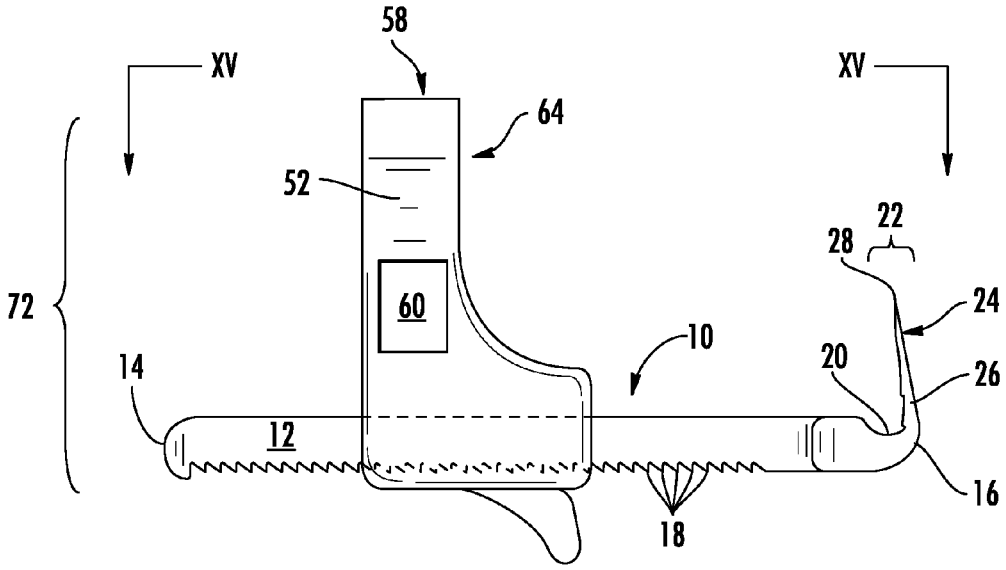
FIG. 14 is a side plan view of the female connector unit on its axial arm.
Figure 15:
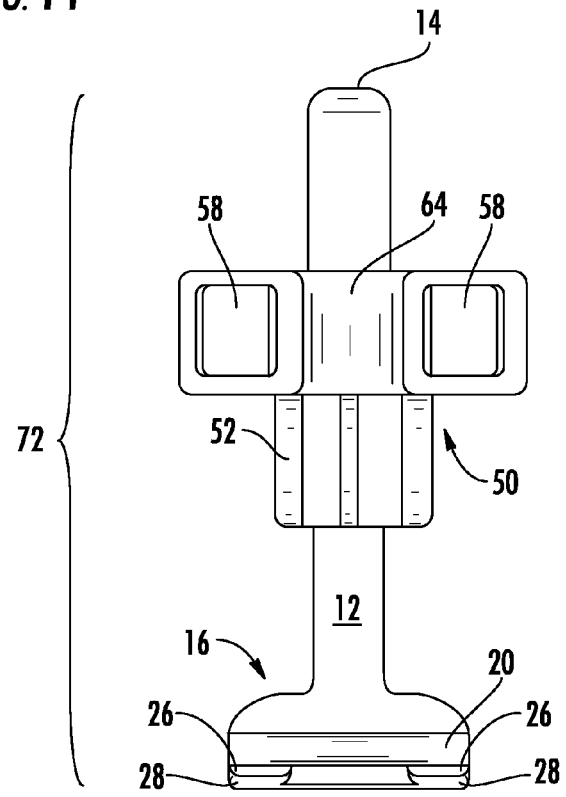
FIG. 15 is a front plan view of the combined elements from FIG. 14 taken along lines XV-XV of FIG. 14.

FIGS. 12 and 13 show an assembled male half unit, generally 70, according to this invention with its particular axial arm 10 passing through aperture 34 in male main body element 32. Dotted lines and dotted teeth wedges in FIG. 12 were added to better illustrate the same. In FIGS. 14 and 15, the equivalent assembled female half unit, generally 72, is depicted with its passage of axial arm 10 also represented by dotted elements in FIG. 14.

Figure 16:
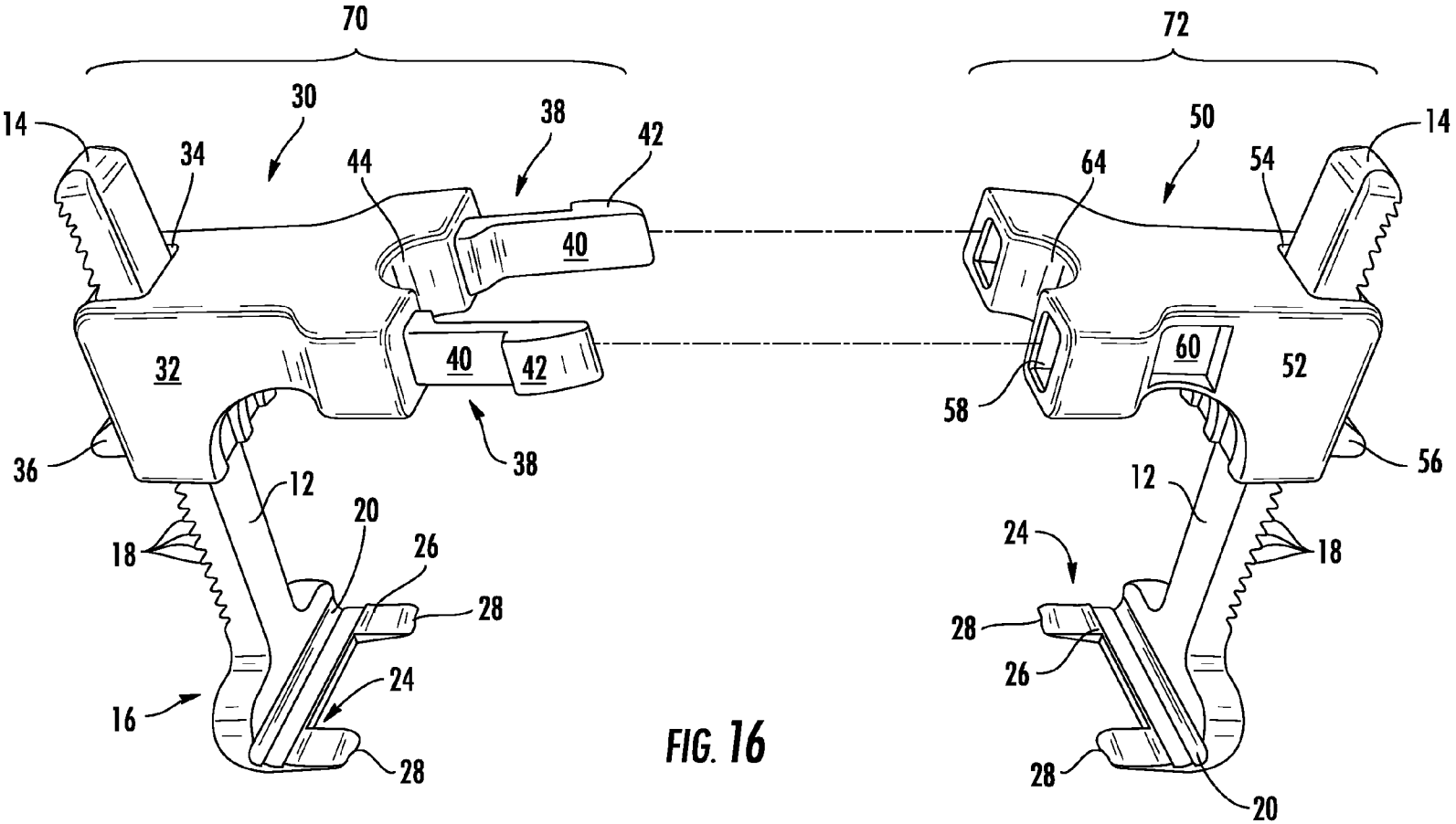
FIG. 16 is a perspective view of the two "half" units which make up one preferred embodiment of this invention.
Figure 17:
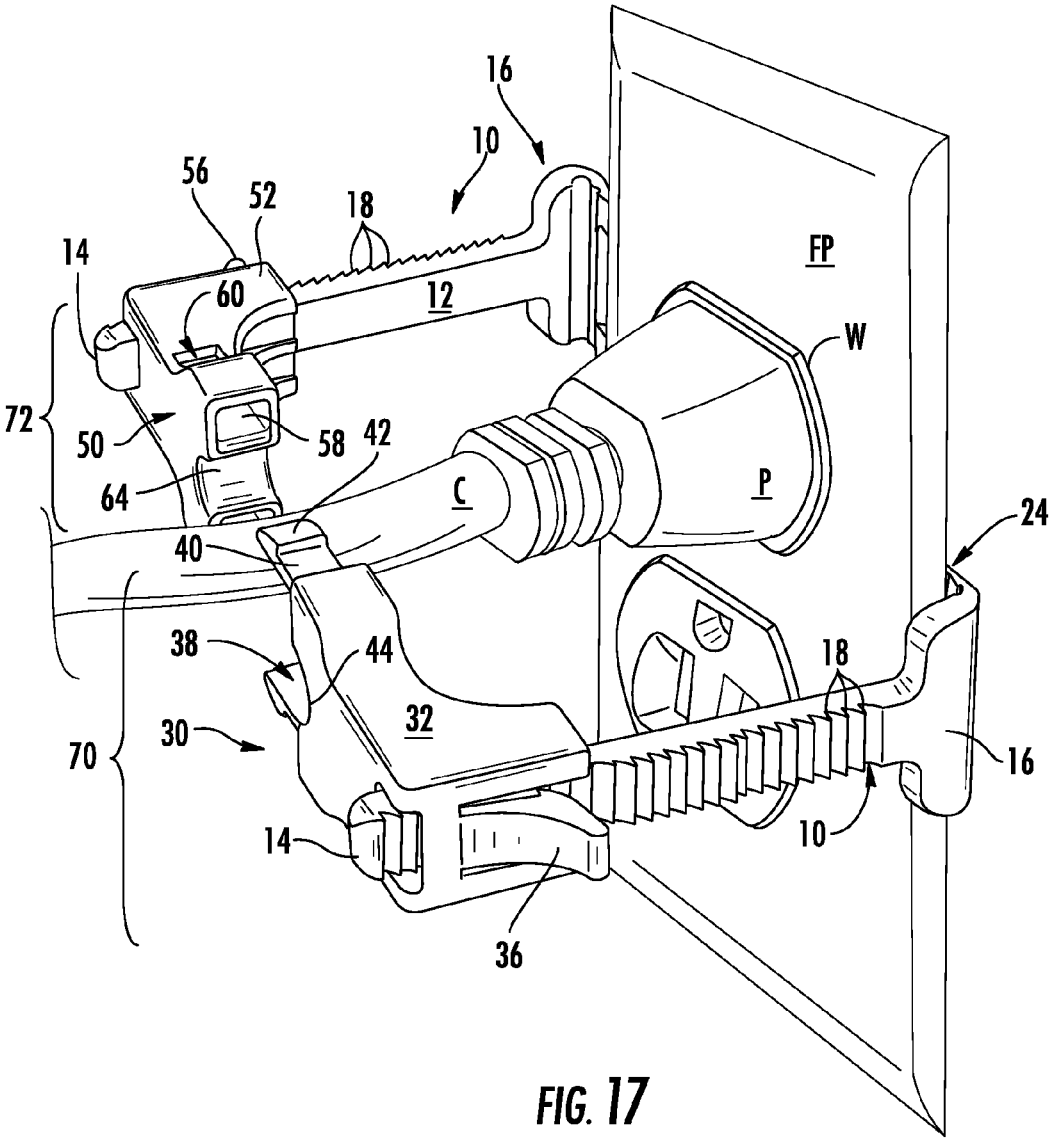
FIG. 17 is a top perspective view showing the two halves from FIG. 16 with their respective flat hook ends (or "prongs") situated behind a standard outlet faceplate cover about to be joined together around the electrical power wire to a plug inserted into its wall outlet.
Figure 18:
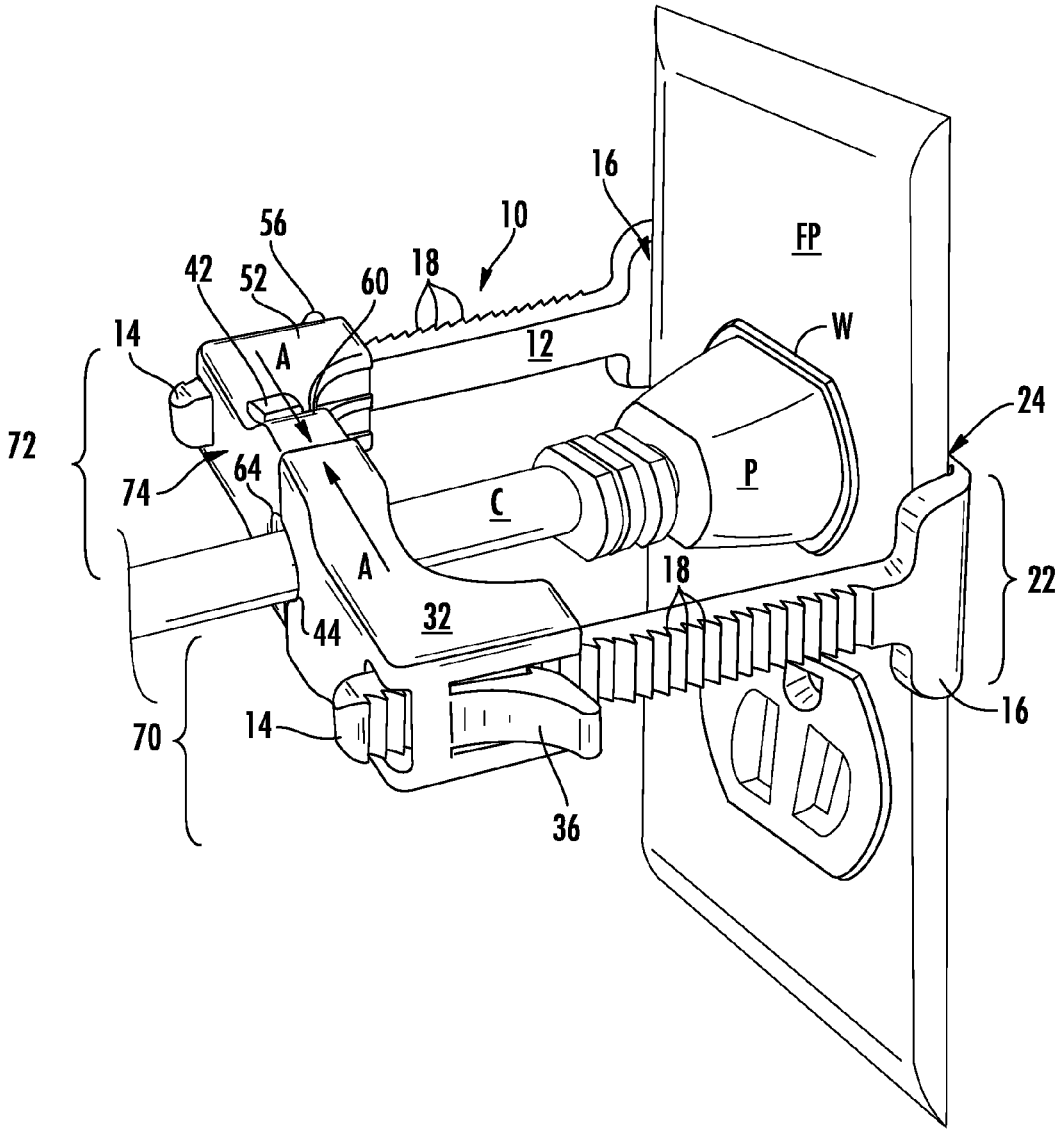
FIG. 18 is a top perspective view showing the two halves from FIG. 17 fully joined together about the power wire thus forming a bridge connector about said wire.
Figure 19:
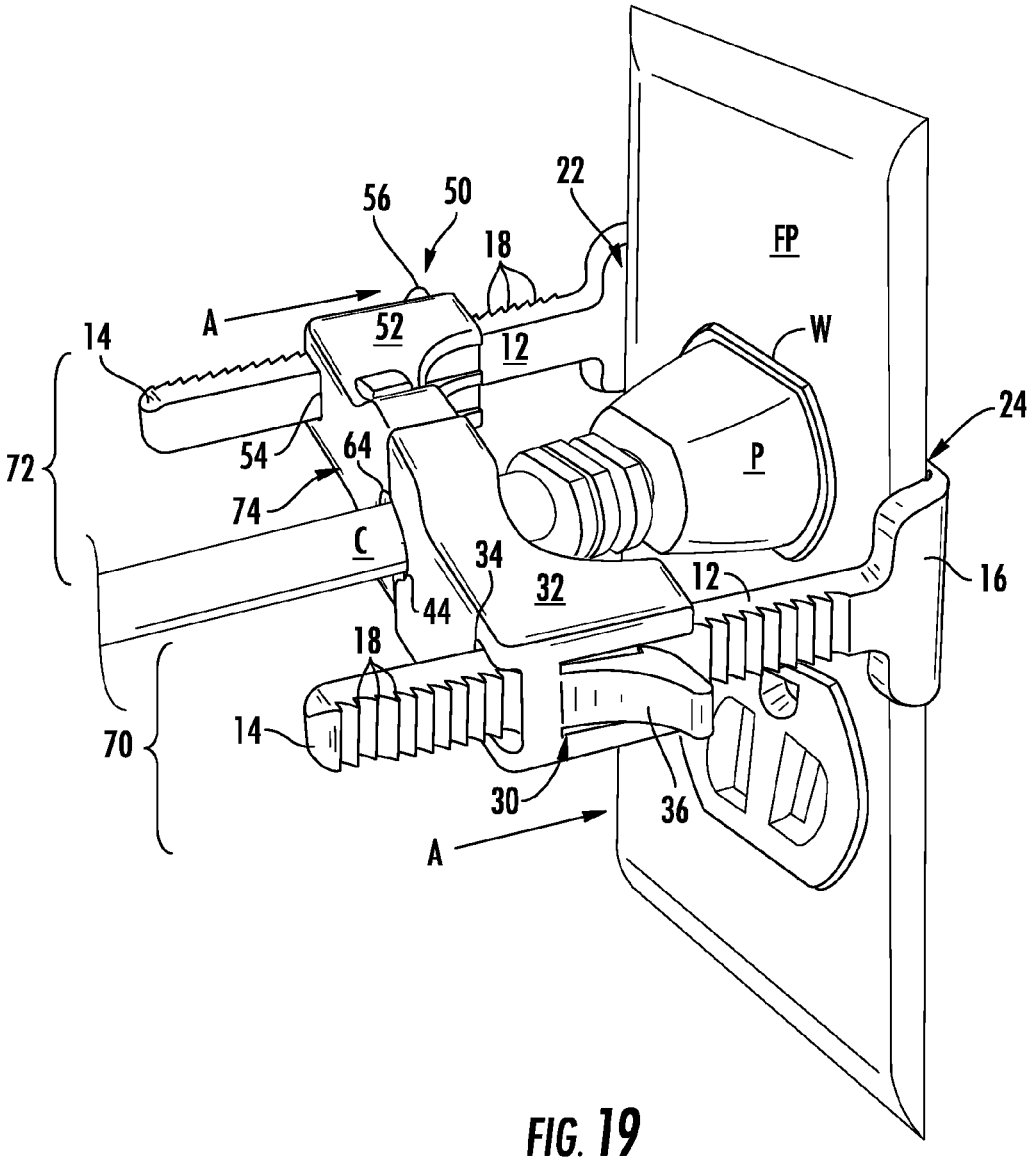
FIG. 19 is a top perspective view showing the fully joined halves from FIG. 18 advanced in the direction of arrows A toward the faceplate cover for "locking" the plug end to its wall outlet according to this invention.

FIGS. 16-19 show, in perspective views, one sequential use of this invention. In FIG. 16, the two main assembled half units, male unit 70 and female unit 72, are positioned with the protrusions 38 aligned for eventual insertion into opposed apertures 58. In FIG. 17, installation of the two halves to this device has commenced. The hooked bottoms to both axial arms have been slid or otherwise wedged behind a perimeter edge/lip to a standard outlet faceplate cover FP. Both male 30 and female 50 units are on their respective axial arms 10, but towards the top ends 14 of same. Arcuate regions 44, 64 are brought towards power cord C, adjacent plug end P. The two half units are then locked together (in the direction of arrows A) to form a bridge-like connector, generally 74, about power cord C as best seen in FIG. 18. Finally, using the two thumb protrusions 36, 56, the device can be advanced "downwardly" or toward wall outlet W and its faceplate cover FP, as indicated by arrows A in FIG. 19) so as to extend substantially parallel with faceplate cover FP and directly against the uppermost edge to plug end P, thereby locking the power cord C and plug end P into its wall outlet W making it quite difficult if not impossible to accidentally pull the plug out and away from the wall proper.

Having described the subject matter of the present invention, it should be understood that many substitutions, modifications, and variations of the invention are possible in light of the foregoing. The invention as taught and described herein is only to be limited to the extent of the breadth and scope of the appended claims.

What is claimed is:

1. A device for securing an electrical cord and plug to a power outlet covered by a standard plate cover, said device comprising:

a first unit having an axial arm that terminates in a base having a plurality of flat hooks for fitting at least partially behind a lateral edge of the standard plate cover, a second unit having an axial arm that terminates in a base having a plurality of flat hooks for fitting at least partially behind a lateral edge of the standard plate cover, said second unit to be fitted behind its plate cover lateral edge opposite the first unit; and means for connecting the first unit to the second unit and forming a bridge about the electrical cord being secured by the device, said bridge designed to slidably adjust along the axial arms of the first and second units in a direction towards the power outlet, wherein the connecting means includes a plurality of protrusions from a bridge member for the first unit and a plurality of apertures in a bridge member for the second unit, said second unit apertures designed to receive said first unit protrusions when connected together to form the bridge.

2. The device of claim 1, wherein each axial arm has at least two flat hooks.

3. The device of claim 1, wherein the bridge slidably adjusts about the electrical cord to an area adjacent the plug being secured to the power outlet with the device.

4. The device of claim 1, wherein both axial arms are polygonal in cross-section and at least one flat side of each arm has a plurality of teeth for engaging with at least one locking clip on the connecting means when the bridge slidably adjusts therealong.

5. The device of claim 1, wherein both axial arms extend substantially perpendicular to the standard plate cover when their flat hooks are fitted behind the lateral edges to the standard plate cover.

6. The device of claim 1, wherein the bridge extends substantially parallel with the standard plate cover.

7. The device of claim 1, wherein the bridge extends substantially perpendicular to both axial arms that the bridge will be slidably adjusted along.

8. The device of claim 1, wherein the bridge members of the first and second units each have an arcuate section that forms an aperture through which the electrical cord extends when connected together to form the bridge.

9. The device of claim 1 which separates from the electrical cord and plug by disconnecting the bridge member for the first unit from the bridge member for the second unit.

10. The device of claim 9, wherein the protrusions from the bridge member for the first unit are adapted to squeeze towards each other for extracting from the apertures in the bridge member for the second unit.

11. A device for securing an electrical cord and plug to a power outlet covered by a standard plate cover, said device comprising:

(a) a male unit having: (i) an axial arm that terminates in a base having at least one flat hook for fitting at least partially behind a lateral edge of the standard plate cover; and (ii) a connecting bridge member with a plurality of protrusions extending laterally therefrom; and (b) a female unit having: (i) an axial arm that terminates in a base having at least one flat hook for fitting at least partially behind a lateral edge of the standard plate cover, said female unit to be fitted behind its plate cover lateral edge opposite the male unit; and (ii) a connecting bridge member with a plurality of apertures designed to receive the protrusions form the bridge member of the male unit when the bridge members are connected together with at least some section of electrical cord situated therebetween.

12. The device of claim 11, wherein both axial arms are polygonal in cross-section and each connecting bridge member includes an aperture through which its axial arm extends.

13. The device of claim 12, wherein at least one flat side of each axial arm has a plurality of teeth for engaging with a locking clip at or near the aperture in each connecting bridge member.

14. The device of claim 11, wherein each axial arm has at least two flat hooks.

15. The device of claim 11, wherein the connected bridge members slidably adjust about the electrical cord and along the axial arms to an area adjacent the plug being secured.

16. The device of claim 11, wherein the connected bridge members extend substantially perpendicular to both axial arms and substantially parallel with the standard plate cover.

17. The device of claim 11, wherein the protrusions from the bridge member for the male unit are adapted to squeeze towards each other for extracting from the apertures in the bridge member for the female unit.

18. The device of claim 11, wherein the bridge members of the male and female units each have an arcuate section that forms an aperture through which the electrical cord extends when connected together to form the bridge.

19. A method for securing an electrical cord and plug to a power outlet covered by a standard plate cover, said method comprising:

(a) providing a device that includes:

(i) a male unit with an axial arm that terminates in a base, said base having at least one flat hook for fitting behind a lateral edge of the standard plate cover, said male unit further including:

an arcuate section that forms part of an aperture through which the electrical cord extends; and a connecting bridge member with a plurality of protrusions extending laterally therefrom; and (ii) a female unit with an axial arm that terminates in a base, said base having at least one flat hook for fitting behind a lateral edge of the standard plate cover, said female unit further including:

an arcuate section that combines with the arcuate section of the male unit to form the aperture through which the electrical cord extends; and a connecting bridge member with a plurality of apertures for receiving the protrusions form the connecting bridge member of the male unit;

(b) fastening the flat hook of the axial arm for the male unit behind the lateral edge of the standard plate cover and the flat hook of the axial arm for the female unit behind the lateral edge of the standard plate cover, said axial arms being located opposite each other when both are fastened to the standard plate cover;

(c) situating the electrical cord between the arcuate sections of the male and female units;

(d) positioning the protrusions from the connecting bridge member of the male unit adjacent the apertures in the connecting bridge member of the female unit;

(e) joining the two connecting bridge members together with the electrical cord extending therethrough; and (f) slidably adjusting the connected bridge members along the axial arms of the male and female units to an area adjacent the plug being secured to the power outlet with the device.

* * * * *